US008365662B2

(12) United States Patent
Aviel et al.

(10) Patent No.: US 8,365,662 B2
(45) Date of Patent: Feb. 5, 2013

(54) DIRECT ENGRAVING OF FLEXOGRAPHIC PRINTING PLATES

(75) Inventors: David Aviel, Tel Mond (IL); Alon Siman-Tov, Or Yehuda (IL); Lior Perry, Ramat Gan (IL)

(73) Assignee: Eastman Kodak Company, Rochester, NY (US)

( * ) Notice: Subject to any disclaimer, the term of this patent is extended or adjusted under 35 U.S.C. 154(b) by 338 days.

(21) Appl. No.: 12/781,149

(22) Filed: May 17, 2010

(65) Prior Publication Data

US 2011/0277649 A1 Nov. 17, 2011

(51) Int. Cl.
*B41C 3/08* (2006.01)

(52) U.S. Cl. ..... 101/401.1; 101/368

(58) Field of Classification Search ..... 101/401.1
See application file for complete search history.

(56) References Cited

U.S. PATENT DOCUMENTS 5,654,125 A * 8/1997 Fan et al. ..... 430/306
6,857,365 B2 * 2/2005 Juffinger et al. ..... 101/401.1
7,800,638 B2 * 9/2010 Ogawa ..... 347/224
7,827,912 B2 * 11/2010 Siman-Tov et al. ..... 101/401.1
2001/0052924 A1 * 12/2001 Steinke et al. ..... 347/225
2003/0006221 A1 * 1/2003 Hong et al. ..... 219/121.72
2003/0047545 A1 * 3/2003 McKee et al. ..... 219/121.71
2008/0153038 A1 6/2008 Siman-Tov et al.

FOREIGN PATENT DOCUMENTS

EP 1 262 316 5/2001

* cited by examiner

*Primary Examiner* — Anthony Nguyen
(74) *Attorney, Agent, or Firm* — Nelson Adrian Blish

(57) ABSTRACT

A system for engraving flexographic printing plates, is presented. A flexographic plate (104) is mounted on an imaging drum 404. Printable areas (204, 304) on the flexographic plate are engraved by an imaging source (408) configured to engrave fine detail information. Non-printable areas (208) are engraved on the flexographic plate by a second imaging source (412, coarse imaging source) capable to engrave substantially deeper (208, 520) than the depth of engraving used for the printable areas. Synchronizing (424) between the fine imaging source and the coarse imaging source, by directing the fine and coarse sources operate simultaneously, whereby the fine source images on the printable areas and the coarse source images the non-printable areas. In addition the fine source engraves the printable data areas (704) and non-printable support areas (708) underneath the printable areas. The non-printable support areas are engraved to be substantially wider than the printable data areas.

3 Claims, 8 Drawing Sheets

DIRECT ENGRAVING OF FLEXOGRAPHIC PRINTING PLATES

CROSS REFERENCE TO RELATED APPLICATIONS

Reference is made to commonly-assigned U.S. patent application Ser. No. 12/781,157 (now U.S. Publication No. 2011/0278767), filed May 17, 2010, entitled DIRECT ENGRAVING OF FLEXOGRAPHIC PRINTING PLATES, by Aviel et al.; and U.S. patent application Ser. No. 11/615,025, filed Dec. 22, 2006, now U.S. Publication No. 2008/0153038, entitled HYBRID OPTICAL HEAD FOR DIRECT ENGRAVING OF FLEXOGRAPHIC PRINTING PLATES, BY Siman-Tov et al., the disclosure of which is incorporated herein.

FIELD OF THE INVENTION

This invention relates to an optical printing head and methods for direct engraving of flexographic printing plates.

BACKGROUND OF THE INVENTION

Direct engraving of a flexography plate 104 (a non-imaged plate shown in FIG. 1) requires carving three-dimensional (3-D), on plate material, directly with a laser system. This is remarkably different from two-dimensional (2-D) imaging techniques that require post processing steps to produce the 3-D features. FIG. 2 and FIG. 3 show a cross section of an imaged flexographic plate 104. Areas 204 represent ink transfer areas, those areas are engraved in a relative shallow depth. Also printable engraved data 304 is shown in FIG. 3. Non-printable areas or non-ink transfer areas 208, are engraved in a significant greater depths than areas 204 and 304, in order to prevent ink transfer from those areas on a printing substrate during the printing process.

This difference introduces several challenges for the laser imaging system:

1. The laser system must have sufficient power to ablate the material; and
2. The laser spot should be small enough to achieve the fine detail required in quality printing.

Although high power density does not necessary conflict with laser focusability, from a practical perspective, these lasers offer significantly higher cost per watt of output optical power than broad spot lasers. As a result, it is desirable to operate with broad laser sources, that may produce high output optical power, rather than with small spot sources, that may have high power density but relatively low total power output.

It is therefore appealing to use a laser system that combines the characteristics of a fine spot laser source to process areas which require fine detail screening and a broad spot laser source for portions of the image where features comprise large solid areas.

An apparatus and methods for utilizing fine spot laser source 408 is shown in FIG. 4, as well as a broad (coarse) spot laser source 412 in a single imaging device 400 (partially shown) to achieve combined characteristics for spot and fine spot imaging, is described in the U.S. Publication No. 2008/0153038.

The two laser sources may be fixed on an imaging carriage 416 in a predefined distance 432 between each other. The imaging carriage 416 is moving substantially in parallel, along the longitudinal axis of the rotating drum 404 in direction 420, directed by direction screw 428. The imaging sources 408 and 412 configured to image on flexographic plate 104 which is mounted on rotating drum 404. The movement of imaging carriage 416 and imaging sources operation is controlled by controller 424.

Due to possible position deviations caused the movement of the imaging carriage 416 during the imaging process, the coarse imaging source 412 might image on areas intended to be imaged by the fine imaging source 408 and vice versa. The fine laser source is configured to image on areas on the plate planned to printed, therefore having the coarse laser source image on those areas might cause printing quality problems to appear during printing.

The current invention suggests an apparatus and method to overcome or at least to minimize those problems.

SUMMARY OF THE INVENTION

Briefly, according to one aspect of the present invention a method for engraving flexographic printing plates is presented. A flexographic plate is mounted on an imaging drum. Printable areas on the flexographic plate are engraved by an imaging source configured to engrave fine detail information.

Non-printable areas are engraved on the flexographic plate by a second imaging source (coarse imaging source) capable to engrave substantially deeper than the depth of engraving used for the printable areas.

Synchronizing between the fine imaging source and the coarse imaging source, by directing the fine and coarse sources operate simultaneously, whereby the fine source images on the printable areas and the coarse source images the non-printable areas.

In addition the fine source engraves the printable data areas and non-printable support areas underneath the printable areas. The non-printable support areas are engraved to be substantially wider than the printable data areas.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

In the following detailed description, numerous specific details are set forth in order to provide a thorough understanding of the disclosure. However, it will be understood by those skilled in the art that the teachings of the present disclosure may be practiced without these specific details. In other instances, well-known methods, procedures, components and circuits have not been described in detail so as not to obscure the teachings of the present disclosure.

While the present invention is described in connection with one of the embodiments, it will be understood that it is not intended to limit the invention to this embodiment. On the contrary, it is intended to cover all alternatives, modifications and equivalents as covered by the appended claims.

The combination of radiation sources with high power broad spots and low power fine spots, referred to as a hybrid optical head system (HOHS), is well suited for 3-D processing of direct engraving flexography applications.

Figure 1:
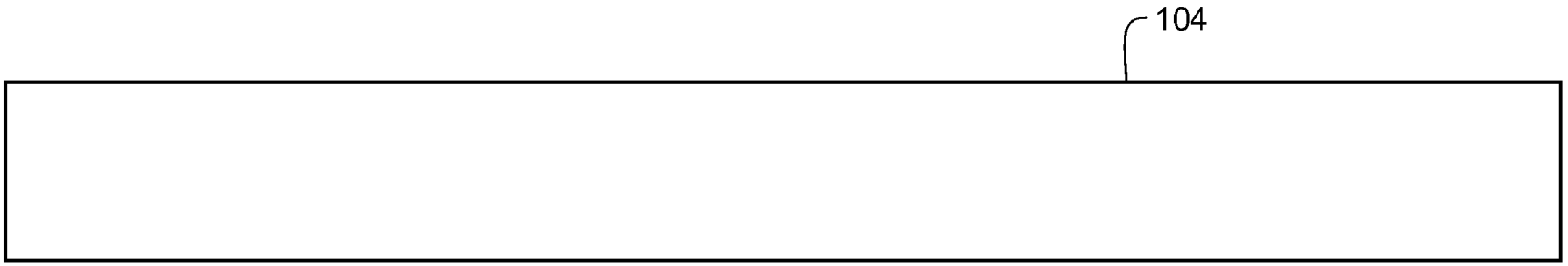
FIG. 1 (PRIOR ART)
FIG. 1 shows a prior art schematic illustration of a non imaged flexographic plate.
Figure 2:
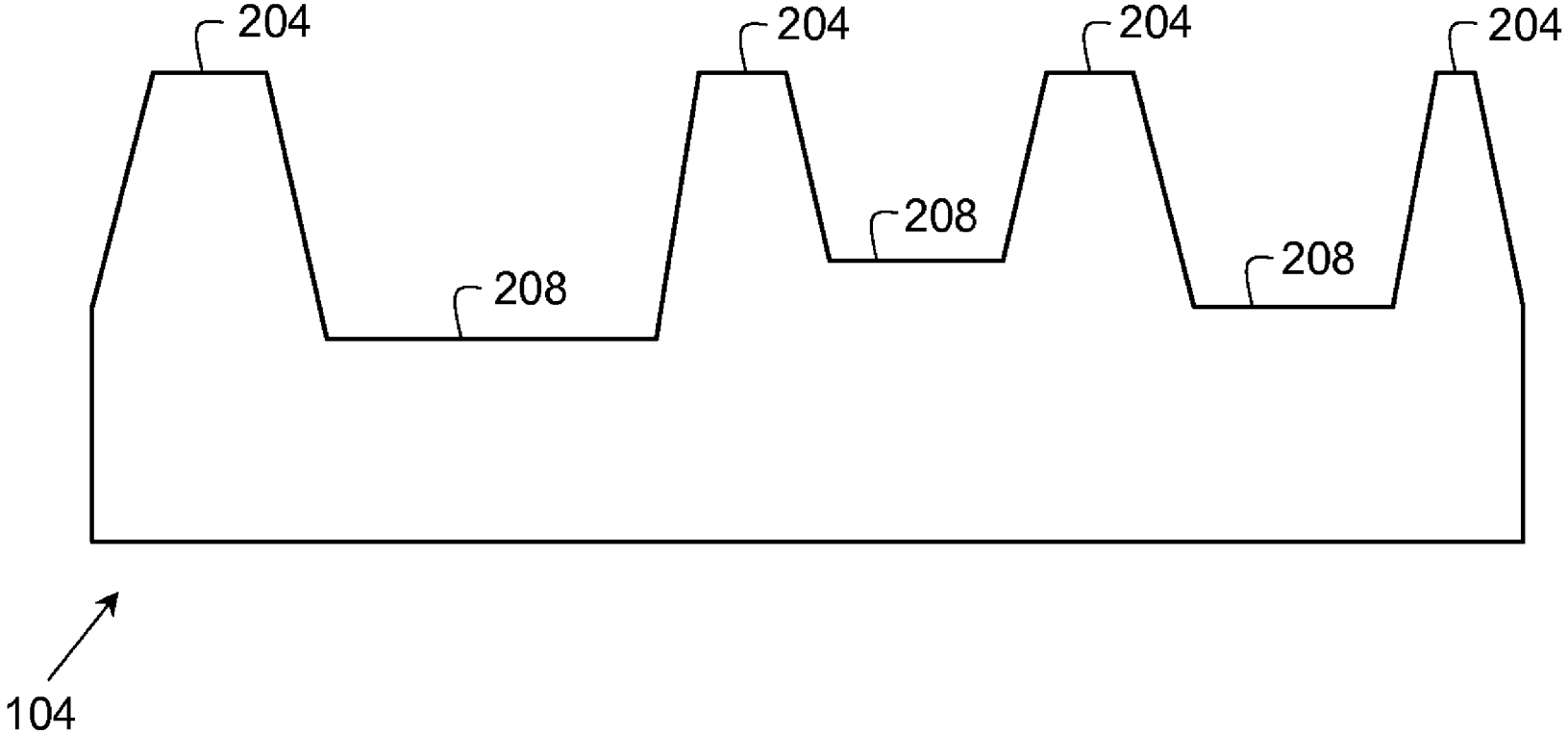
FIG. 2 (PRIOR ART)
FIG. 2 shows a prior art cross-section of an imaged flexographic plate, demonstrating printable and non-printable areas on plate.
Figure 3:
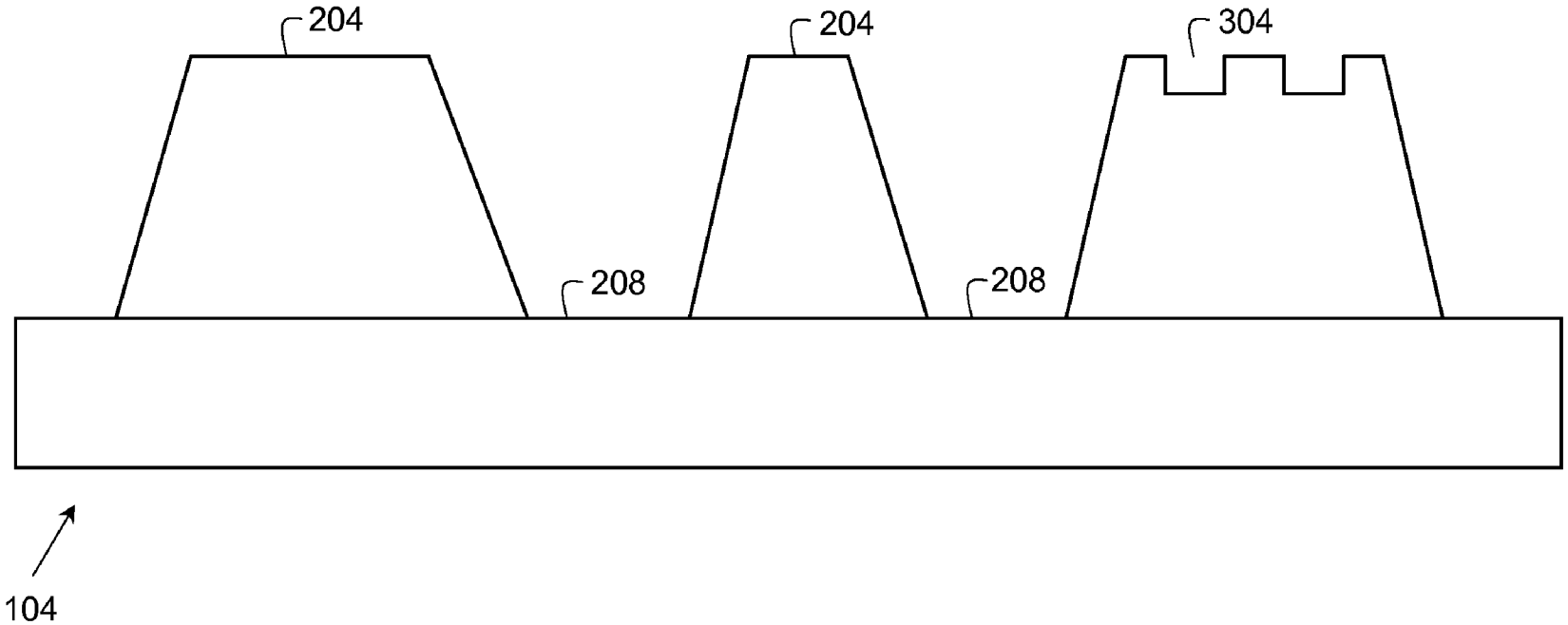
FIG. 3 (PRIOR ART)
FIG. 3 shows a prior art cross-section of an imaged flexographic plate, showing fine detail engraved data in addition to information shown in FIG. 2.
Figure 4:
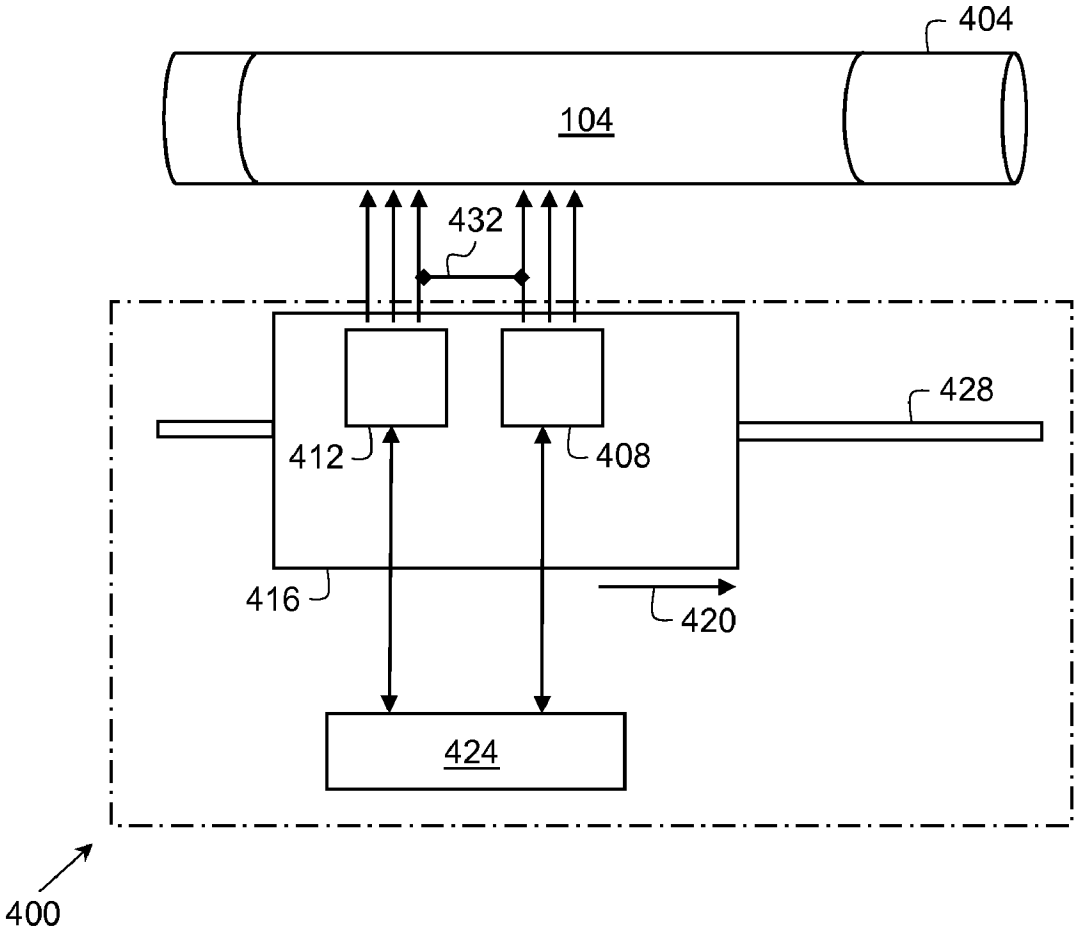
FIG. 4 (PRIOR ART)
FIG. 4 shows a prior art imaging system with fine and coarse laser source configured to image on a flexographic plate mounted on an imaging drum.

Referring to FIG. 3, flexographic plate 104 is being pressed firmly against contact surface (not shown) during printing. Because flexographic plate 104 may be deformable due to its flexible features, imaging areas 204 and 304 separated by non-printable areas 208 (typically used to produce solid areas in imaging) will be deformed more strongly and pushed closer to contact surface than imaging areas (204, 304) typically used to produce fine detail areas in imaging. Therefore, non-printable areas 208 must maintain greater depth than printable areas (204, 304) to prevent contact with the printed media surface. Therefore, printable areas 204 may be engraved by the radiation system to a shallower depth than that required for the non-printable areas 208. The HOHS takes advantage of the fact that large solid areas need to be processed to a depth which is greater than that required for fine detail.

The laser sources (408, 412), fine and broad, may be integrated into a single imaging carriage 416, or each of the laser sources (408, 212) can be mounted of separate imaging carriages. In each configuration, the laser sources are controlled and driven independently of each other.

In operation, flexographic plate 104 is attached to rotating drum 404 and then spun. While spinning, controller 424 directs coarse imaging source 412 to ablate non-printable, typically large areas 208 that are greater than or equal to the spot size of the coarse imaging source 412. The course imaging source 412 is directed by controller 424 to image at coarse source imaging areas 520 (shown in FIG. 5). The fine imaging source 408 is directed by controller 424 to ablate certain small areas, areas requiring fine detail 204, those fine imaging areas 512. Imaging sources 408 and 412 are position on a single carriage 416 or on separate carriages, sources 408 and 412 are configured to image on flexographic plate 104 while they distance 432 between the sources is predefined.

Figure 5:
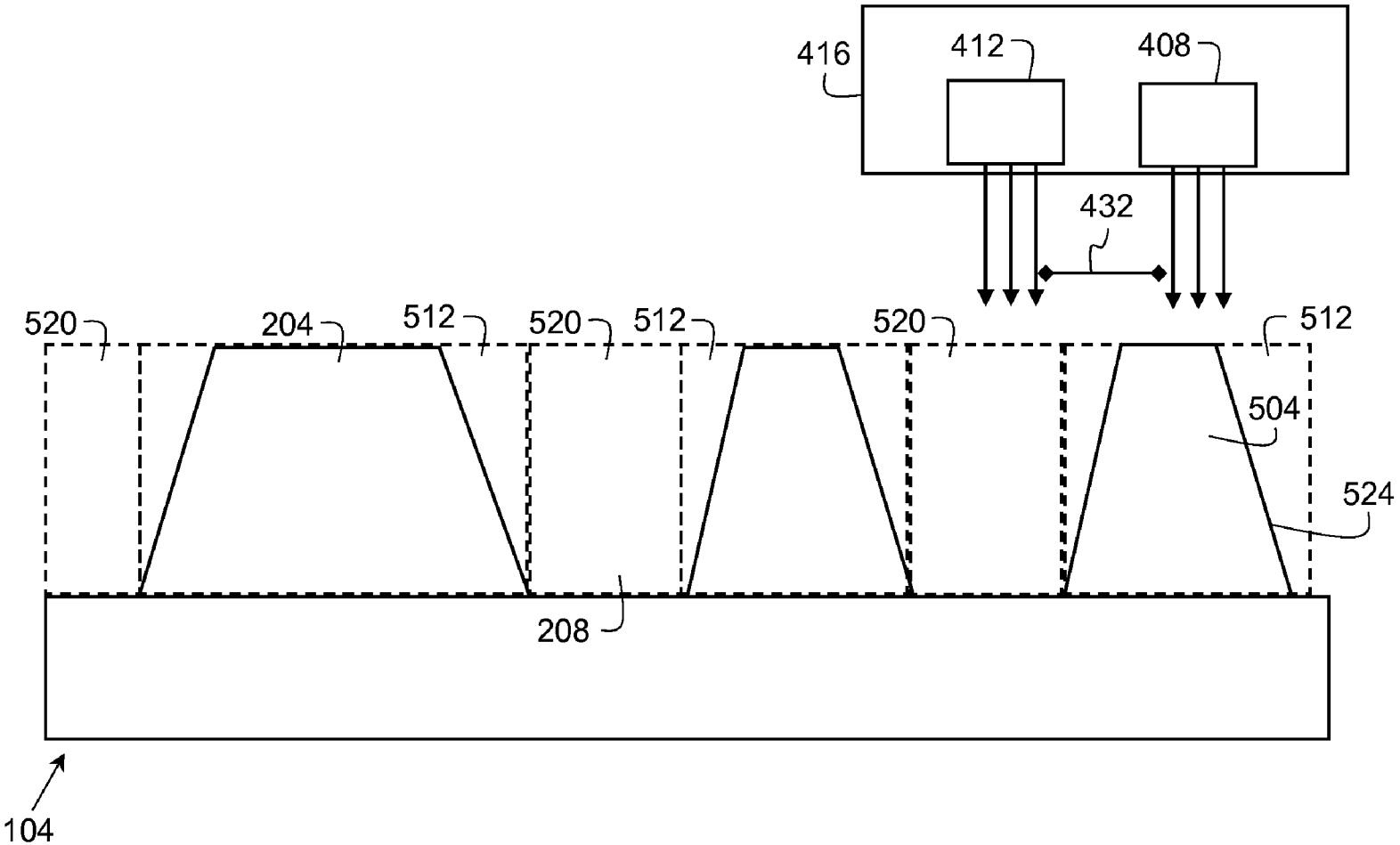
FIG. 5 (PRIOR ART)
FIG. 5 shows a prior art engraved flexographic plate, indicating areas on the plate affected by imaging of fine or coarse laser sources.

The result of imaged flexographic plate 104 made by HOHS imaging head is shown in FIG. 5. The printable areas 204, engraved by the fine imaging source 408 in the areas 512 where fine imaging source 408 was directed to image, are engraved in trapezoid shapes 504. The non-printable areas 208 engraved by the coarse imaging source 412, practically removing all the material from within areas 520, where coarse imaging source 412 is directed to engrave at.

Figure 6:
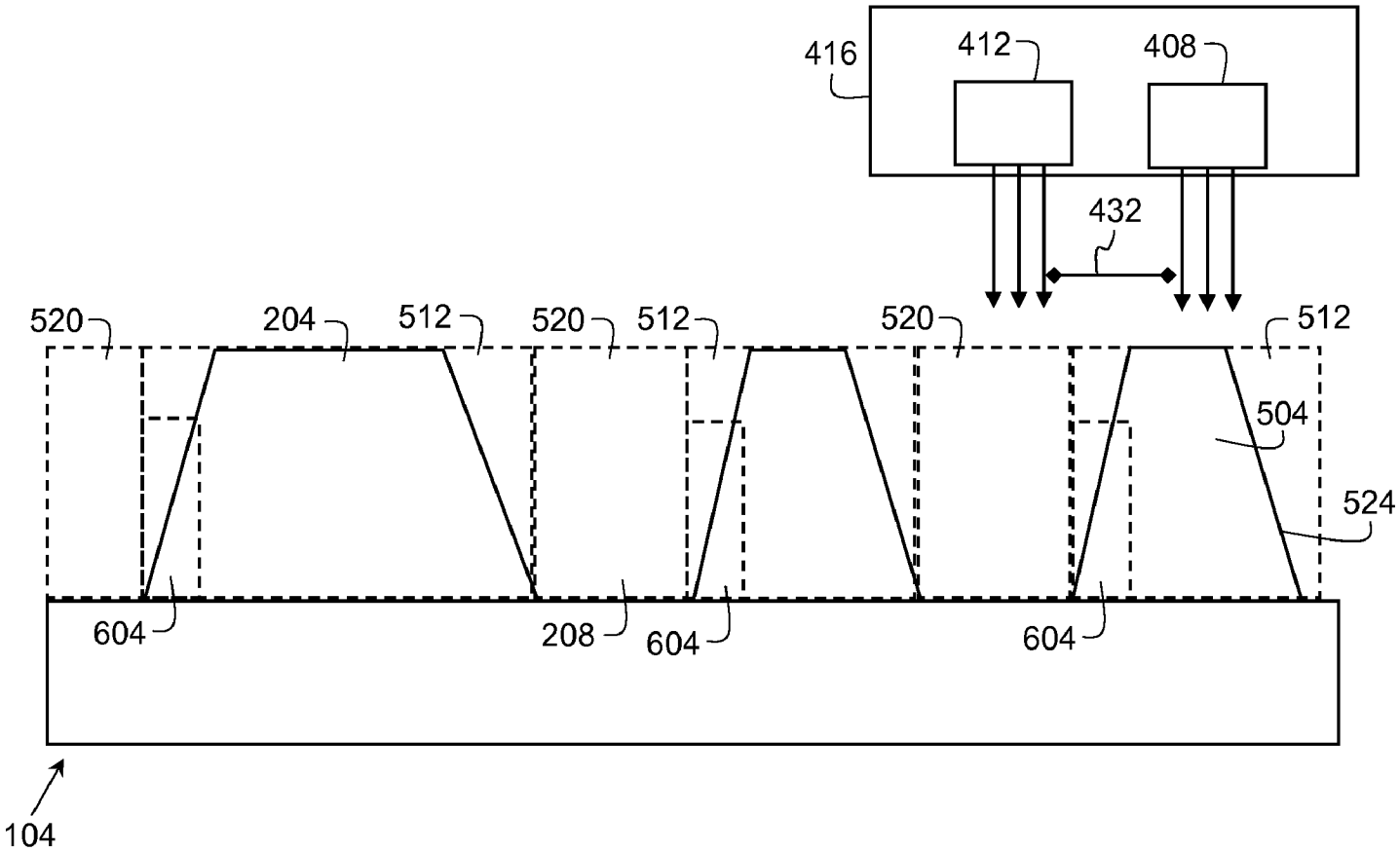
FIG. 6 (PRIOR ART)
FIG. 6 shows problems on the imaged plate created due to inaccuracies in laser sources position or carriage movement during imaging (prior art)

However, the imaging results of flexographic plate 104 shown in FIG. 5, are hardly achieved in real imaging conditions. Due to possible position inaccuracies described earlier that may be caused by the movement of the imaging carriage 416 during the imaging process and the relative narrow trapezoid shoulders 524, the coarse imaging source 412 might image on areas intended to be imaged by the fine imaging source 408. FIG. 6 shows the results of imaging where coarse imaging source 412 images on areas 604, which are originally planned to be strictly imaged by fine imaging source 408. Such inaccuracies might end up with fault imaged flexographic plates 104, or in reduced printing quality while imaged plates 104 are used in printing.

Figure 7:
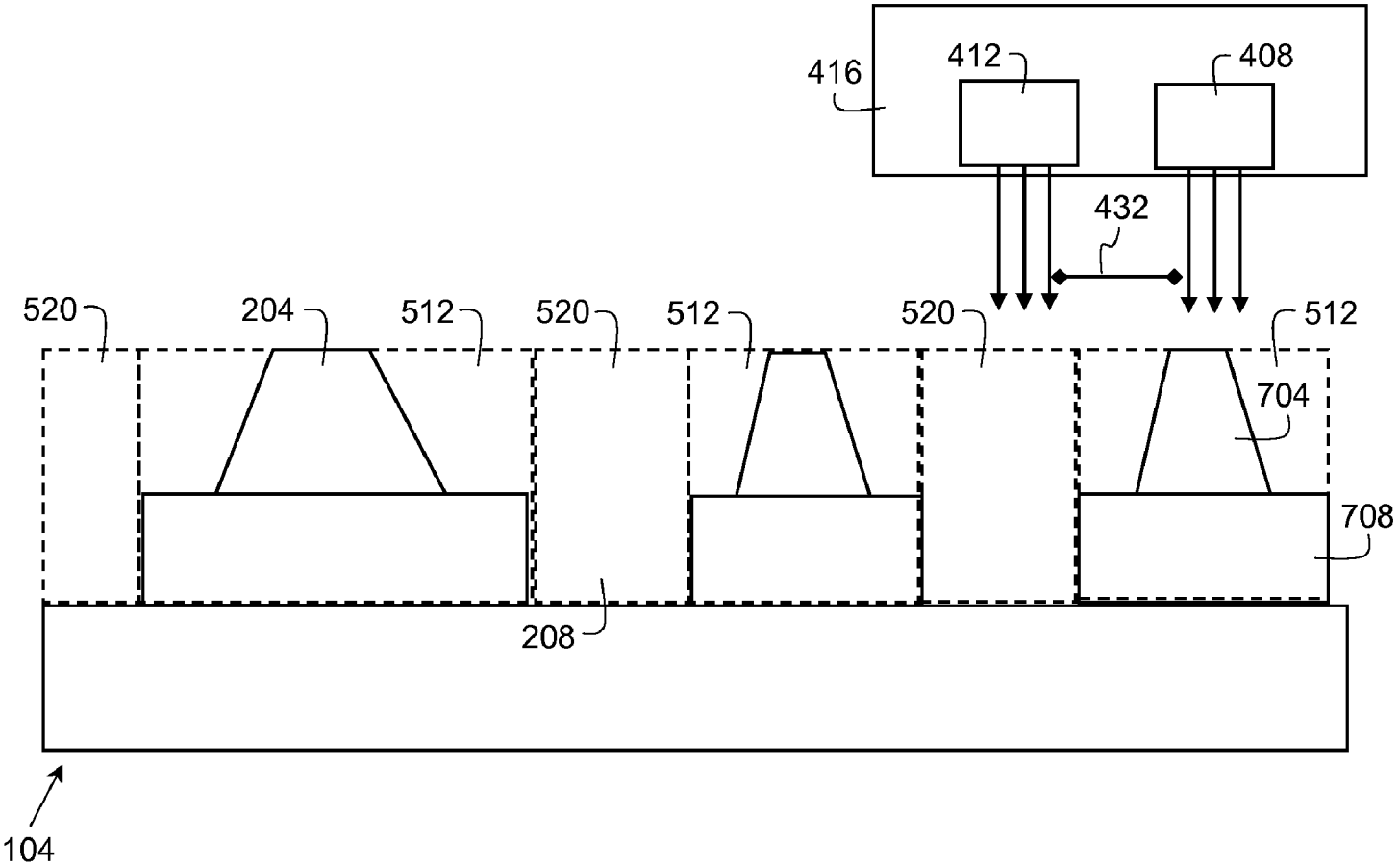
FIG. 7 shows a solution that may reduce artifacts described in FIG. 6.
Figure 8:
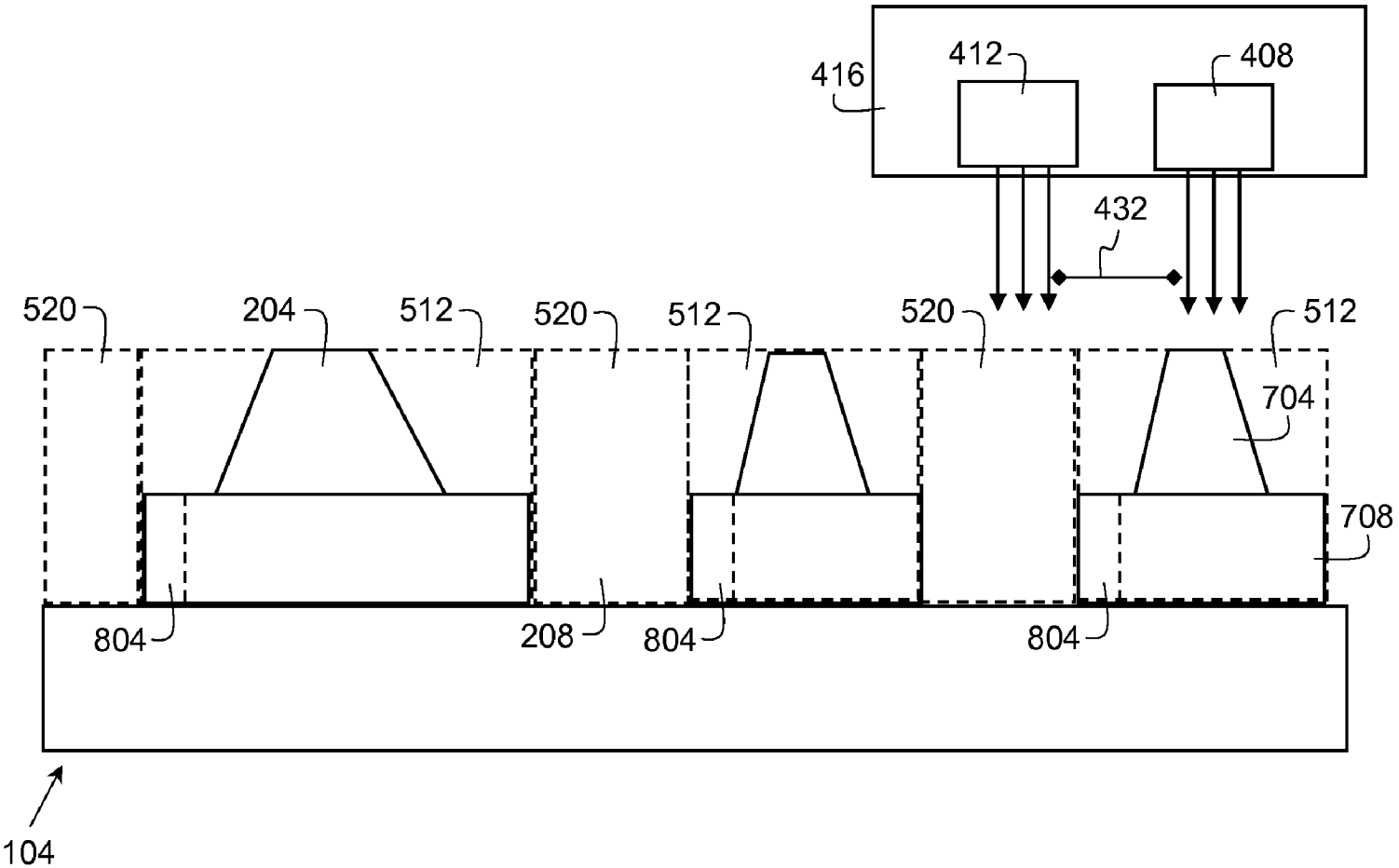
FIG. 8 shows artifacts on plate still created in conjunction with the solution offered in FIG. 7, however it will not be seen on printed substrate.

FIG. 7 and FIG. 8 depict the main idea of the proposed solution for the previously described problem is to direct the fine imaging source 408 engrave shapes slightly different than straight trapezoids 504. Instead trapezoids with wide bases 704 will be engraved. They are created with wide base 708 (or shoulders), the wide base 708 is engraved deep enough in the plate 104 and as such will not be printed. Such shapes having a wide base 708 are known in the flexography art, they are usually formed to enhance the stability of the imaging areas during the printing stage.

The usage of trapezoid shapes with wide base (704, 708) in the present invention provides a better quality imaging results of plate 104, as is depicted by FIG. 8. Coarse imaging source 412 may engrave portions intended to be solely engraved by source 408, as is indicated by numerals 804, however those areas are not printed, and the main shape structure 704 is not significantly damaged. The combination forming shapes 704 in conjunction with HOHS imaging head (fine 408 and coarse 412 imaging sources) represent the essence of the current invention.

The invention has been described in detail with particular reference to certain preferred embodiments thereof, but it will be understood that variations and modifications can be effected within the spirit and scope of the invention.

PARTS LIST

104 flexographic plate
204 ink transfer areas
208 blank areas—non-ink transfer areas
304 engraved information
400 imaging system
404 rotating drum
408 fine imaging source
412 coarse imaging source
416 imaging carriage
420 imaging carriage moving direction
424 controller
428 direction screw
432 distance between fine and coarse sources
504 trapezoid imaging shape
512 fine source imaging area
520 coarse source imaging area
524 trapezoid shoulders
604 coarse source wrote in fine area
704 engraved trapezoid shapes with a wide base
708 wide base (shoulders)
804 coarse source wrote in fine area

The invention claimed is:

1. A system for engraving flexographic printing plates, comprising:

first imaging source adapted to engrave printable areas of a flexographic plate;

second imaging source adapted to engrave non-printable areas of said flexographic plate wherein the depth of engraving of said non-printable areas are substantially deeper than the depth of said printable areas;

a controller configured to synchronize between said first imaging source and said second imaging source wherein said controller directs said first imaging source to engrave said printable areas and said second imaging source to engrave said non-printable areas; and wherein said controller directs said first imaging source to engrave said printable areas and engrave non-printable areas underneath said printable areas.

2. The system according to claim 1 wherein said non-printable areas are substantially wider than said printable areas.

3. The system according to claim 1 wherein said first imaging source is positioned at a distance from said second imaging source wherein said non-printable areas are minimally affected by engraving of said second imaging source.

* * * * *